United States Patent [19]

Lakra

[11] 4,089,315

[45] May 16, 1978

[54] FUEL INJECTION SYSTEMS

[75] Inventor: Paul Lakra, Wembley, England

[73] Assignee: Lucas Industries Limited, Birmingham, England

[21] Appl. No.: 727,230

[22] Filed: Sep. 27, 1976

[30] Foreign Application Priority Data

Oct. 3, 1975 United Kingdom ..... 40482/75

[51] Int. Cl.[2] ..... F02M 39/02

[52] U.S. Cl. ..... 123/139 AK; 123/139 AS; 123/139 AT; 123/139 DP

[58] Field of Search ..... 123/139 AK, 139 AS, 123/139 AT, 139 DP

[56] References Cited

U.S. PATENT DOCUMENTS

| | | | |
|---|---|---|---|
| 1,850,250 | 3/1932 | Salis | 123/139 AS |
| 2,150,574 | 3/1939 | Amery | 123/139 AT |
| 3,752,136 | 8/1973 | Knight et al. | 123/139 DP |
| 3,796,206 | 3/1974 | Links | 123/139 AK |

FOREIGN PATENT DOCUMENTS

| | | | |
|---|---|---|---|
| 494,964 | 12/1954 | Italy | 123/139 AK |
| 393,793 | 6/1933 | United Kingdom | 123/139 AS |
| 363,114 | 12/1931 | United Kingdom | 123/139 AS |

OTHER PUBLICATIONS

"New Pressure-Time Fuel System," The Oil Engine and Gas Turbine, Apr. 1961, pp. 438–440.

*Primary Examiner*—Charles J. Myhre
*Assistant Examiner*—Parshotam S. Lall

[57] ABSTRACT

A fuel injection system for supplying fuel to an internal combustion engine includes a displacement piston which can be moved to displace fuel through a valve controlled outlet. The piston can contact the valve to prevent further flow of fuel through the outlet and the valve during continued movement of the displacement piston can contact a push rod which in turn can exert a force on a stepped valve member to close the valve member to prevent flow of fuel from said outlet through spray orifices.

6 Claims, 1 Drawing Figure

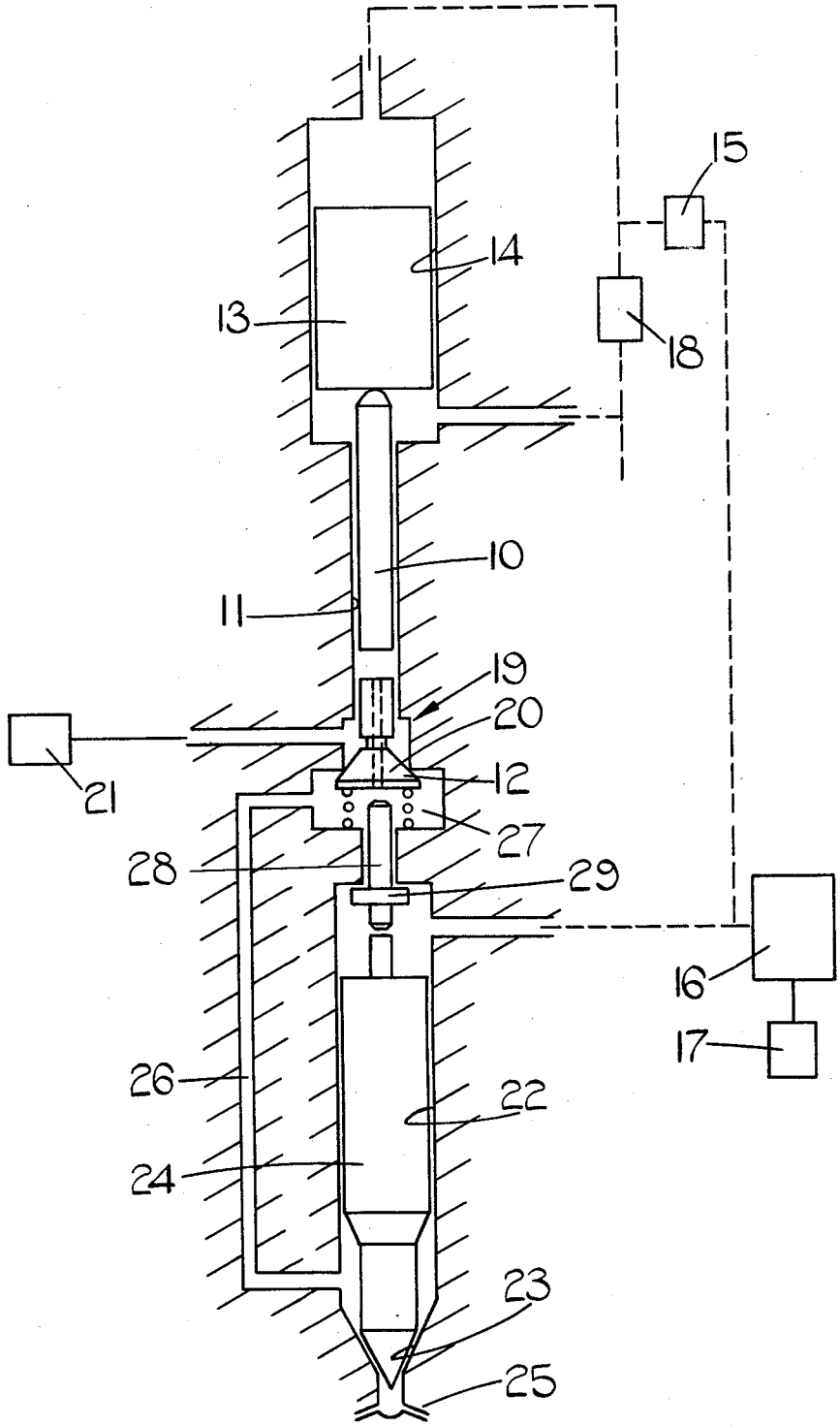
15
14
13
18
10
11
19
20
21
12
27
28
29
16
17
26
22
24
23
25

FUEL INJECTION SYSTEMS

This invention relates to fuel injection systems for supplying fuel to an internal combustion engine and has for its object to provide such a system in a simple and convenient form.

According to the invention a fuel injection system comprises a displacement piston movable within a first cylinder, an outlet from one end of the cylinder, a valve engageable by said piston during the movement of the piston towards said one end of the cylinder, said valve when operated by said piston acting to lower the pressure in said one end of the cylinder, a second cylinder, a stepped valve member slidable in said second cylinder, the narrower end of said valve member being shaped to co-operate with a seating defined at one end of said second cylinder to control the flow of fuel through an orifice from said one end of the second cylinder, the wider end of said valve member being subject to a fluid pressure acting to urge the valve member into contact with the seating, the area defined between the narrower and wider portions of the valve member being subject to the pressure at said outlet whereby when said pressure is sufficiently high the valve member will be lifted from its seating to permit flow of fuel, and a push pin interposed between said valve and said valve member, whereby during continued movement of the displacement piston after engaging said valve, the push pin will transmit motion between said displacement piston and said valve member whereby the valve member will be positively moved in the direction to prevent flow of fuel through said orifice.

According to a further feature of the invention said valve after a limited movement by said displacement piston contacts said push pin to impart the motion of the displacement piston to the valve member.

One example of a fuel injection system in accordance with the invention will now be described with reference to the accompanying diagrammatic drawing.

Referring to the drawing, there is provided a displacement piston 10 slidable within a cylinder 11 at one end of which is defined a seating 12. The displacement piston 10 is engageable by an operating piston 13 slidable within a further cylinder 14 having a diameter larger than the cylinder 11. The end of the cylinder 14 remote from the displacement piston 10 can be connected by way of a valve 15 to an accumulator 16 in which fuel is stored at high pressure. The accumulator is charged by means of a fuel pump 17. The aforesaid end of the cylinder 14 can be connected with a drain by way of a valve 18 and the opposite end of the cylinder 14 is in constant communication with the drain.

Located within the cylinder 11 is a valve 19 having a head 20 engageable with the seating 12. A coiled compression spring loads the head into contact with the seating and a passage extends through the valve between its opposite ends. The aforesaid seating is defined about a slightly enlarged portion of the cylinder 11 and the space defined about the valve communicates with a source 21 of fuel at low pressure.

Also provided is a second cylinder 22 in which is defined a seating 23 engageable by the shaped end of the narrower portion of a stepped valve member 24. The valve member 24 is engageable with the seating 23 to prevent flow of fuel through orifices 25, into a combustion space of the associated engine. The space defined between the narrower and wider portions of the valve member communicates by way of a passage 26, with a chamber 27 containing the spring which loads the valve 19. Moreover, the opposite end of the cylinder 22 is in constant communication with the accumulator 16.

The operation of the system will now be described. When the valve 15 is opened the piston 13 is subjected to the pressure within the accumulator 16 and it moves downwardly as shown in the drawing. During such movement the displacement piston 10 is also moved and a high fuel pressure is generated within the cylinder 11. This pressure by way of the passage in the valve 19, is applied to the step defined on the valve member 24. The dimensions and the pressure applied are such that the valve member 24 is lifted from the seating 23 to permit flow of fuel through the orifice or orifices 25. This flow of fuel continues until the displacement piston 10 engages the valve 19 and when this occurs the head 20 of the valve 19 is lifted from its seating with the result that the pressure in the passage 26 is reduced to that of the source 21. The pressure of the source 21 is very much lower than that required to maintain the valve member 24 in the open position and as a result, the pressure from the accumulator applied to the valve member, moves the valve member towards the seating.

It will be seen therefore that the delivery of fuel to the engine terminates when the valve 19 is lifted. When delivery of fuel has ceased the valve 15 is closed and the valve 18 opened and in this situation fuel from the source 21 maintains the valve member 19 in the open position and fuel flows into the cylinder 11 thereby displacing the piston 10 in an upward direction and corresponding movement of the piston 13 takes place. The extent of movement of these pistons is a measure of the amount of fuel which will be supplied to the engine at the next deivery stroke and therefore the movement of the pistons is closely controlled in any convenient manner. When the valve 18 is closed no further movement of the pistons can take place and the valve 19 is then closed by the action of the spring. The system is then ready for the next delivery of fuel.

In order to promote rapid closure of the valve member 24 onto the seating 23, it is arranged that the movement of the displacement piston 10 is transmitted to the valve member 24 after the head 20 of the valve has been lifted from its seating. This is accomplished by means of a push pin 28 positioned between the valve member 24 and the valve 19. It will be noted that the push pin 28 is provided with a collar 29 to limit its upward movement and the pin also serves to limit the upward movement of the valve member 24 when fuel is being delivered through the orifices 25. It will further be noted that a clearance exists between the push pin and the head 20 of the valve 19. In operation therefore when the displacement piston 10 engages the valve 19 and after the aforesaid clearance has been taken up, the displacement piston 10 will urge the valve member 24 towards the seating 23 thereby achieving rapid and postive movement of the valve member 24 into contact with its seating.

It should be noted that when valves 15 and 18 are closed as is the case when the displacement piston has moved back the required amount, the pressure acting on the push pin 28 is such that the collar 29 is pressed into firm engagement with the end of the cylinder 22. When the valve 15 is opened the pressure in the chamber 27 is increased above the pressure in the accumulator and therefore the pin is moved downwardly into engagement with the valve member 24. Thus there is an increased force on the valve member tending to maintain the valve member in the closed position. It should also be noted that the end of the pin 28 is not intended to close the passage in the valve 19.

It will be appreciated that the drawing is diagrammatic and the pistons 10 and 13 together with the guide portion of the valve 19, the push pin 28 and the valve member 24 are sliding fits with the walls of the respective cylinders or bores so as to minimize fuel leakage therebetween. It will also be appreciated that the drawing is not intended to show the actual dimensions of the various parts but in a practical example the pressure within the accumulator 16 is 300 ATM and the pressure developed by the displacement piston approximately 600 ATM. The diameters of the various items are as follows, the operating piston 7mm, the displacement piston 5mm, the push pin 2mm and the larger portion of the valve member 6mm with the seat diameter of the valve member approximately 3mm. The diameter of the seat of the valve 19 is 6.4mm and the pressure of fuel of the source 10ATM.

I claim:

1. A fuel injection system for supplying fuel to an internal combustion engine comprising a displacment piston movable within a first cylinder for generating a first fluid pressure, an outlet from one end of the cylinder, a valve engageable by said piston during the movement of the piston towards said one end of the cylinder, said valve when operated by said piston acting to lower the first pressure in said one end of the cylinder, a second cylinder for generating a second fluid pressure, a stepped valve member slidable in said second cylinder, the narrower end of said valve member being shaped to co-operate with a seating defined at one end of said second cylinder to control the flow of fuel through an orifice from said one end of the second cylinder, the wider end of said valve member being subject to said second fluid pressure to urge the valve member into contact with the seating, the area defined between the narrower and wider portions of the valve member being subject to said first pressure at said outlet whereby when said first pressure is sufficiently high the valve member will be lifted from its seating to permit flow of fuel, and a push pin interposed between said valve and said valve member, whereby during continued movement of the displacement piston after engaging said valve, the push pin will transmit motion between said displacement piston and said valve member whereby the valve member will be positively moved in the direction to prevent flow of fuel through said orifice.

2. A system according to claim 1 in which the valve after a limited movement by said displacement piston contacts said push pin to impart the motion of the displacement piston to the valve member.

3. A system according to claim 2 in which said valve is biased by a spring into contact with a further seating.

4. A system according to claim 3 in which said valve when opened allows fuel to be displaced to a source of fuel at low pressure.

5. A system according to claim 4 in which said push pin is provided with a flange engageable with the other end of the second cylinder to limit the movement of the stepped valve member away from the seating.

6. A system according to claim 5 including piston means for effecting movement of the displacement piston, said piston means having a working area larger than said displacement piston and valve means operable to apply said second fluid pressure to said piston means to effect movement of said displacement piston in a direction to displace fuel through said outlet.

* * * * *